US005350116A

United States Patent [19]

Cater

[11] Patent Number: 5,350,116

[45] Date of Patent: Sep. 27, 1994

[54] DISPENSING APPARATUS

[75] Inventor: Miro S. Cater, Newtown, Conn.

[73] Assignee: Bespak PLC, Norfolk, United Kingdom

[21] Appl. No.: 25,420

[22] Filed: Mar. 1, 1993

[51] Int. Cl.[5] ..... B05B 7/24

[52] U.S. Cl. ..... 239/333; 239/357; 239/361; 239/369; 239/405; 222/631; 222/635

[58] Field of Search ..... 239/333, 337, 340, 343, 239/349, 350, 355, 357, 361, 369, 370, 371, 372, 403, 404, 405; 222/631, 635

[56] References Cited

U.S. PATENT DOCUMENTS

| | | | |
|---|---|---|---|
| 4,057,176 | 11/1977 | Horvath | 239/333 X |
| 4,089,442 | 5/1978 | Hafele et al. . | |
| 4,122,982 | 10/1978 | Giuffredi | 239/337 |
| 4,179,049 | 12/1979 | Umstead | 222/631 |
| 4,214,677 | 7/1980 | Bauer et al. | 239/333 X |
| 4,230,242 | 10/1980 | Meshberg . | |
| 4,274,560 | 6/1981 | Cater . | |
| 4,735,347 | 4/1988 | Shultz et al. . | |
| 4,776,498 | 10/1988 | Maerte et al. . | |
| 4,830,284 | 5/1989 | Maerte . | |
| 5,080,266 | 1/1992 | O'Neill | 222/635 |
| 5,100,029 | 3/1992 | Meshberg | 239/333 X |
| 5,110,052 | 5/1992 | Graf et al. | 239/333 |
| 5,115,981 | 5/1992 | Callahan et al. | 239/405 X |
| 5,147,087 | 9/1992 | Fuchs | 239/333 |
| 5,163,588 | 11/1992 | Cater . | |
| 5,289,952 | 3/1994 | Gueret | 239/370 X |
| 5,295,628 | 3/1994 | Zuckschwerdt | 239/434 X |

FOREIGN PATENT DOCUMENTS

| | | |
|---|---|---|
| 0451615 | 11/1991 | European Pat. Off. . |
| 2825428 | 12/1979 | Fed. Rep. of Germany . |
| 8702225 | 4/1989 | Netherlands . |

OTHER PUBLICATIONS

"A Two Phase Flow Mechanical Spray Pump: A Possible Alternative to Propellant Driven MDIs", Reinhold Jaeger-Waldau, *Journal of Biopharmaceutical Sciences*, vol. 3, pp. 77-84.

*Primary Examiner*—William Grant

*Attorney, Agent, or Firm*—Beveridge, DeGrandi, Weilacher & Young

[57] ABSTRACT

An actuator for a liquid spray pump is provided with a skirt which co-operates with a body of the pump to compress a volume of air during pump actuation. Air compressed by this action is ejected from an air injection channel in the vicinity of a liquid spray emerging from a first nozzle defined by the actuator. A second nozzle is connected to the actuator externally of the first nozzle to define an air gap therebetween and the air ejection channel communicates with the air gap such that in use both the liquid spray and the compressed air are dispensed through the second nozzle aperture. Primarily intended for dispensing water based products, the effect of the compressed air is to assist in the evaporation of water contained in the liquid or any other volatile liquid dissolved in a liquid product to be dispensed in aerosol form.

13 Claims, 3 Drawing Sheets

36
37
9
20
11
10
15
14
24
12
18
17
16
8
13
19
30
31
1
34
38
32
4
40
41
39
5
7
3
2
50
6

DISPENSING APPARATUS

BACKGROUND OF THE INVENTION

This invention relates to apparatus for dispensing liquid as an atomised spray and in particular but not exclusively to apparatus for dispensing a water-borne liquid product.

Recent trends in the manner in which hair sprays and the like have been delivered in aerosol form have resulted in liquid products being dispensed in aqueous solution by manually operated pumps for example. The use of environmentally damaging volatile propellants is thereby avoided, but users find the characteristics of the resulting water-borne spray to be less desirable in some respects.

It has been proposed in U.S. Pat. No. 4057176 to improve the quality of a water-borne spray by dispensing compressed air simultaneously with dispensed liquid in order to both assist the breakup of the spray into finely divided particles and to produce a drier spray in the sense that some of the water content is evaporated from the sprayed liquid as a consequence of compressed air being entrained in the spray. It has also been proposed in U.S. Pat. No. 5100029 to provide a delivery means with an actuator which is constructed so as to provide compressed air during actuation by a pumping action associated with manual depression of the actuator.

In each of the above disclosures the compressed air is mixed with a flow of liquid from a delivery means in a mixer chamber upstream of a nozzle and the subsequent mixture is then dispensed through a nozzle as an atomised spray.

SUMMARY OF THE INVENTION

According to the present invention there is disclosed an apparatus for dispensing liquid as an atomised spray comprising a delivery means, an actuator defining a dispensing channel and being operatively connected to the delivery means whereby the delivery means is operable by relative movement of the actuator to deliver a flow of liquid from a reservoir to the dispensing channel, a first nozzle connected to the actuator and defining a first nozzle aperture communicating with the dispensing channel, air pumping means operable by movement of the actuator relative to the delivery means to compress an enclosed volume of air during actuation of the delivery means and the actuator defining an air ejection channel for the release of the compressed air, wherein the apparatus further comprises a second nozzle connected to the actuator externally of the first nozzle and having a rear face spaced from a front face of the first nozzle to define an air gap therebetween, the air gap communicating with the second nozzle aperture and the air ejection channel whereby in use both the liquid spray and the compressed air are dispensed through the second nozzle aperture.

An advantage of such apparatus is that the compressed air becomes entrained in the liquid spray thereby promoting drying of any water content in the liquid or any other volatile liquid dissolved in the product dispensed in aerosol form. This improves the quality of the product applied to a given surface. In particular where the product is a hair spray it is advantageous to have as much of the water content of the spray removed as possible.

The entrainment of air also assists in further breaking-up the particle size of the liquid spray.

Preferably the delivery means comprises a body having an actuator engaging portion co-operating with the actuator to define an air chamber, the actuator and the actuator engaging portion being telescopically movable relative to one another to thereby vary the volume of the chamber and constitute the air pumping means.

An advantage of such apparatus is that an existing delivery means may be adapted to receive the enhancing benefits of the compressed air flow referred to above simply by addition of an appropriate actuator and a simple modification to the casing of the delivery means to provide an actuator engaging portion. This modification is external to the internal working components and can thereby be achieved with minimal difficulty.

A further advantage is that a delivery means may selectively be fitted with an actuator in accordance with the present invention or with a conventional actuator not providing the functions and advantages of the present invention simply by choice of actuator at the point of assembly.

Conveniently the actuator engaging portion comprises a tubular projection of the body and the actuator comprises a depending cylindrical, skirt slidably engaging the tubular projection.

Preferably the skirt is received within the tubular projection in sliding contact with an internal cylindrical surface of the tubular projection.

An advantage of such an arrangement is that any liquid which becomes drawn into the air chamber 32 for example during the return stroke of the actuator will tend to accumulate within a recess defined by the tubular projection 39 and is unlikely to leak out of the air chamber 32 on to the external surfaces of the apparatus.

Preferably the rear face of the second nozzle is conically tapered in a direction towards the first nozzle, the air ejection channel communicating with the air gap at a location circumferential relative to the rear face of the second nozzle whereby in use a radially inward flow of air entering the air gap is deflected by the rear face of the second nozzle towards the first nozzle.

The air is thereby deflected by the front face of the first nozzle so as to impinge upon and become 10 entrained with the jet of liquid droplets emerging from the first nozzle.

Preferably the first nozzle comprises a centrally located axial projection defining the first nozzle aperture and projecting towards the second nozzle.

The effect of the axial projection is to allow the axial length of the first nozzle aperture to be extended without increasing the axial thickness of the first nozzle as a whole. It is believed that the effect of the axial projection also has additional benefits in achieving the satisfactory entrainment of air in the liquid spray.

Preferably the second nozzle comprises a plurality of axially projecting fins extending non-radially from the rear face of the second nozzle so as to induce swirling motion in air flow in the air gap.

The swirling effect created within the air flow aids in the entrainment of air in the liquid droplet spray and in the effect of breaking-up the spray into finer droplets.

Conveniently the second nozzle comprises a second insert received in a bore defined by the actuator and wherein the fins project into contact with the first nozzle to thereby locate the second nozzle relative to the first nozzle.

Location of the first and second nozzles can thereby be accurately achieved in a simple manner.

Advantageously the second nozzle comprises a front face defining a conically divergent throat which diverges in a direction away from the first nozzle.

The effect of the divergent throat is to assist in controlling the divergence of the resulting spray and may be varied to produce different effects.

Conveniently the first nozzle comprises a first insert received in the bore defined by the actuator and wherein the air gap is annular and bounded by the first insert, the second insert and an intermediate portion of the bore.

A preferred embodiment of the delivery means comprises a tubular stem upon which the actuator is mounted and comprises a dispensing pump actuated by depression of the tubular stem.

Alternatively the delivery means may comprise a pressurised dispensing container having a dispensing valve actuated by depression of a valve stem upon which the actuator is mounted.

A preferred embodiment of the present invention will now be described by way of example only and with reference to the accompanying drawings.

DETAILED DESCRIPTION OF THE INVENTION

Figure 1:
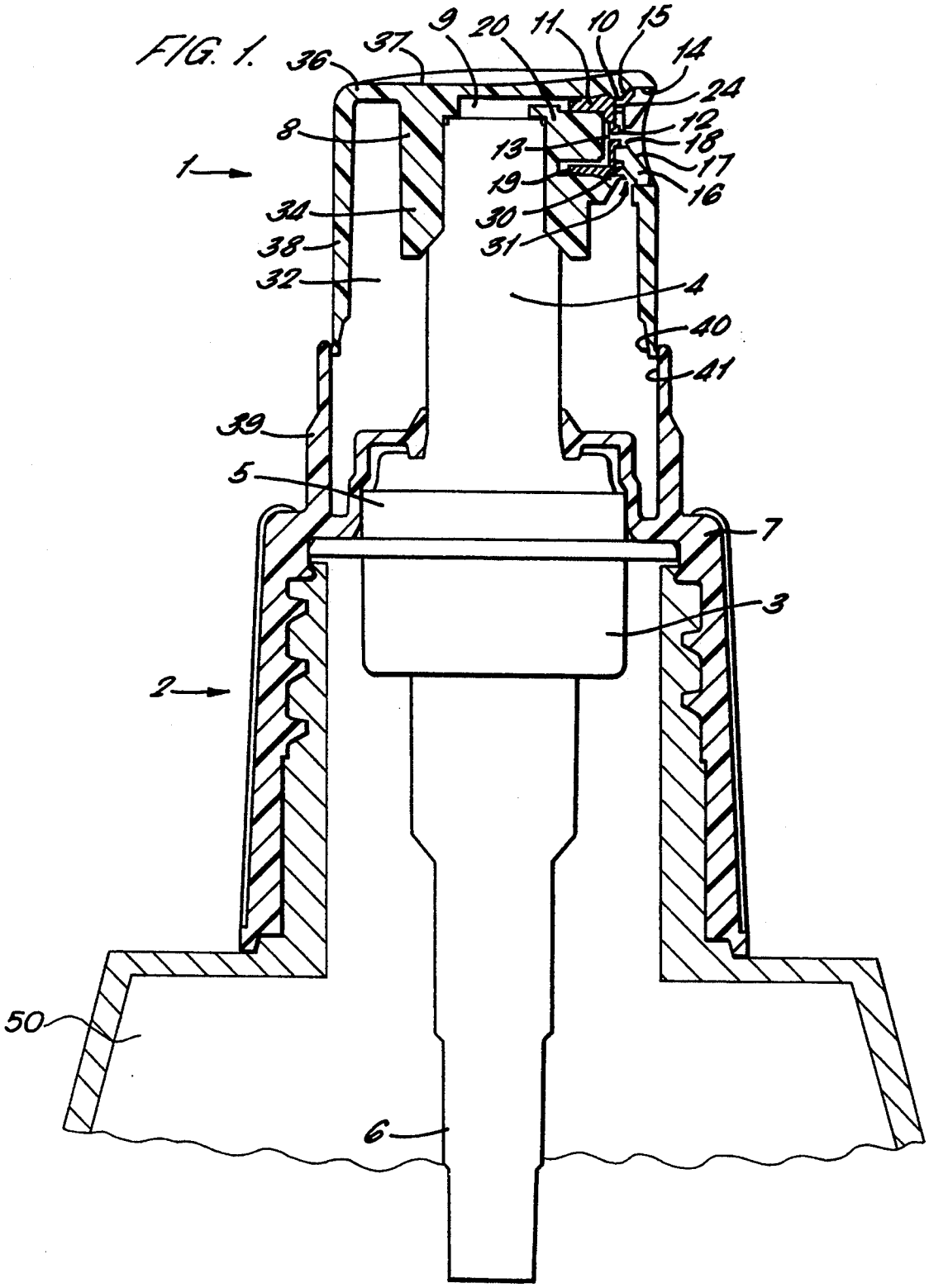
Fig. 1 is a sectioned elevation of an apparatus in accordance with the present invention.

In FIG. 1 an apparatus 1 comprises a delivery means 2 in the form of a manually operable dispensing pump 3. The pump 3 has a tubular stem 4 through which liquid is delivered when the stem is depressed relative to a generally cylindrical body 5, the pump having an inlet tube 6 normally immersed in the reservoir of liquid. The pump 3 has a casing 7 adapted to be screw fitted to a reservoir of liquid 50.

Figure 2:
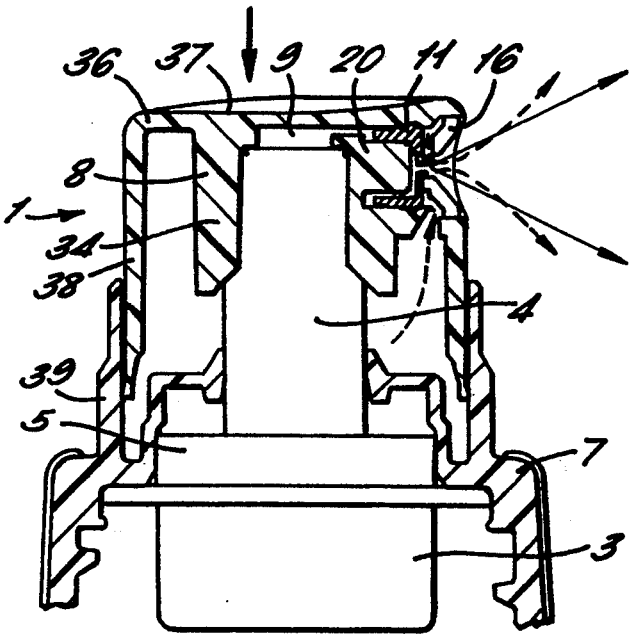
FIG. 2 is a detail of the apparatus of FIG. 1 showing the flow of air and liquid during a dispensing stroke.
Figure 3:
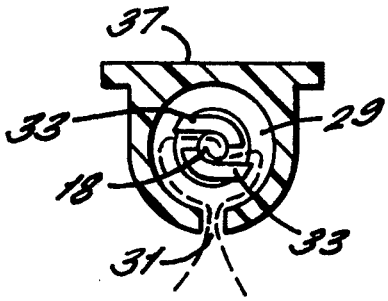
FIG. 3 is a sectional view showing detail of a second nozzle insert.

An actuator 8 is received as a push fit on the stem 4 and defines a dispensing channel 9 communicating with the stem so as to receive a flow of liquid during a dispensing stroke of the pump 3 in which the actuator is depressed relative to the body as shown in FIG. 2.

The actuator 8 defines a generally cylindrical bore 10 receiving a first insert 11 which provides a first nozzle 12 having a first nozzle aperture 13 communicating with the dispensing channel 9.

An outer portion 14 of the bore 10 is formed with an enlarged diameter and is connected with the remainder of the bore by an intermediary portion 15 of tapering diameter.

A second insert 16 is received in the outer portion 14 as a push fit and is annular in shape to form a second nozzle 17 defining a second nozzle aperture 18.

The first insert 11 has a cylindrical portion 19 received on a boss 20 forming part of the actuator 8, the first insert including four radially inwardly projecting and axially extending ribs 21 contacting the boss to provide fluid channels therebetween communicating with the dispensing channel 9. The cylindrical portion 19 is closed at its forward end by an end wall 22 in which the first nozzle aperture 13 is centrally formed and in which non-radial grooves 23 are formed so as to define non-radial swirl inducing ducts delivering fluid from the dispensing channel 9 via the fluid channels defined by ribs 21 to the aperture 13.

The first insert 11 thereby forms the first nozzle 12 and is further provided with a forward face 24 from which a centrally located tubular axial projection 25 extends.

The first nozzle aperture 13 is therefore formed as a cylindrical duct extending coaxial with the bogs 20 and the first insert 11.

The second nozzle 17 has a front face 26 which is conically divergent to provide a throat 27 communicating with the second nozzle aperture 18 defined by an inner annular portion 28. The inner annular portion 28 is spaced axially from the axial projection 25 of the first nozzle 12 and the second nozzle aperture 18 is of greater diameter than the first nozzle aperture 13 with which it is coaxially aligned.

The second nozzle 17 has a rear face 29 which is conically tapered in a direction towards the first nozzle 12. An air gap 30 is defined between the rear face 29 of the second nozzle 17 and the front face 24 of the first nozzle 12.

An air ejection channel 31 is provided in the intermediary portion of the bore 15 so as to communicate with the radially outer periphery of the annular air gap 30, the channel 31 communicating with an air chamber 32 formed within the actuator 8 as described in greater detail below.

The rear face 29 of the second nozzle 17 is provided with non-radially extending fins 33 arranged to impart swirling motion to air passing through the air gap 30 from the channel 31 to the second nozzle aperture 18. The fins 33 extend axially into contact with the front face 24 of the first insert 12 thereby determining the relative axial locations of the fire and second inserts.

The actuator 8 is generally cylindrical in shape and in the normal upright orientation of the apparatus as shown in the Figures the actuator has a tubular socket 34 having a vertical cylindrical axis and which receives the stem 4 as a sealing fit. A horizontal protrusion 35 extends radially from the socket 34 and defines the dispensing channel 9 and the bore 10 which receives the first and second inserts 11 and 16.

The socket 34 is formed integrally with a cap 36 with a horizontal upper surface 37 to which finger pressure is applied in use to actuate the apparatus.

The cap 36 has a depending cylindrical skirt 38 with a cylindrical axis extending coaxially with the socket 34 and stem 4, the skirt being received as a sliding fit within the tubular projection 39 of the body 5. The skirt 38 has a lower rim 40 which is slightly flared so as to make sliding sealing contact with an internal cylindrical surface 41 of the tubular projection 39. The air chamber 32 is thereby bounded externally by the skirt 38 and the tubular projection 39 and internally by the valve stem 4 so as to be annular in shape and is entirely sealed except for the channel 31. The skirt 38 is telescopically slidable within the tubular projection 39 so as to vary the volume of the air chamber 32 and the resulting change of air pressure results in a flow of air through the channel 31.

In use, the rest position of the apparatus 1 as shown in FIG. 1 is maintained by the stem 4 being spring biassed into a fully extended position as shown. To dispense a liquid spray the actuator 8 is manually depressed so that the actuator and stem 4 travel towards the body 5.

A flow of pressurised liquid is delivered via the stem 4 into the dispensing channel 9 and emerges as a jet of atomised liquid from the first nozzle aperture 13. As shown in FIG. 2, the volume of air chamber 32 progressively decreases during the dispensing stroke thereby pressurising the volume of air within the air chamber so that a flow of air leaves the air chamber via channel 31 and is directed into the air gap 30.

The fins 33 induce swirling motion to the flow of air in the air gap 30. The air flow is directed towards the forward face 24 of the first insert nozzle from which it is deflected so as to emerge from the second nozzle aperture 18 so as to annularly surround the atomised jet of liquid from the first nozzle 12.

The air flow is entrained in the liquid spray and tends to evaporate any water content in the liquid and any other volatile constituent in the spray. This tends to improve the quality of the spray when it is eventually incident upon the surface to which the product is applied in aerosol form.

Figure 4:
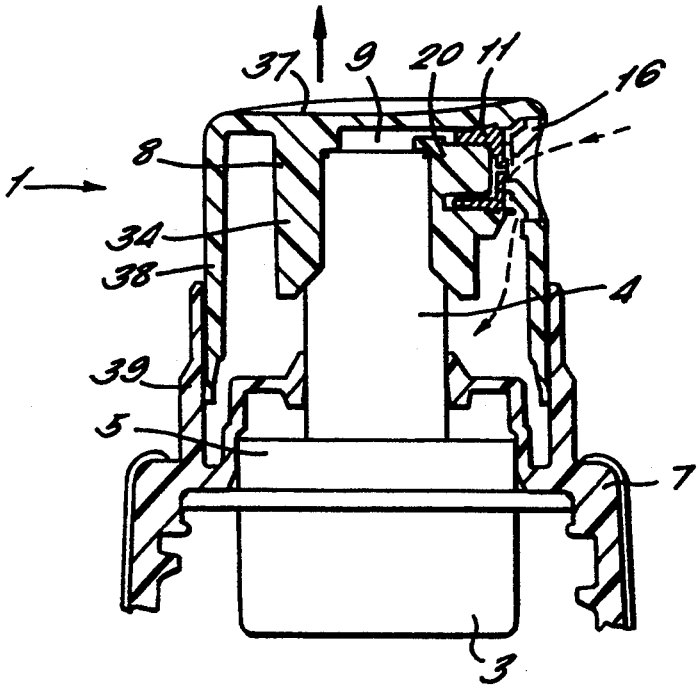
FIG. 4 is a further sectional elevation of the apparatus of FIGS. 1 and 2 showing the flow of air during the return stroke of the actuator.
Figure 5:
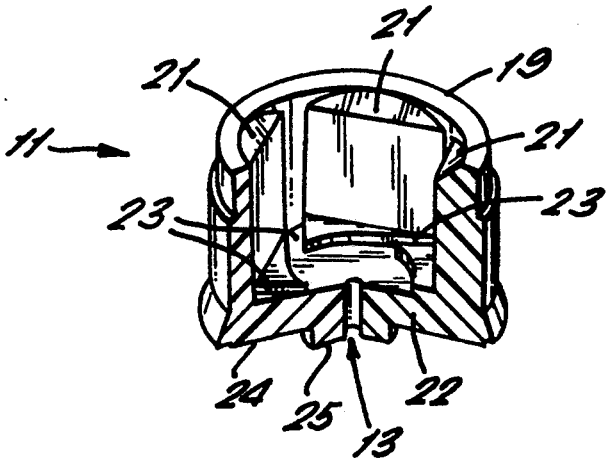
FIG. 5 is an enlarged perspective view of the first nozzle insert.
Figure 6:
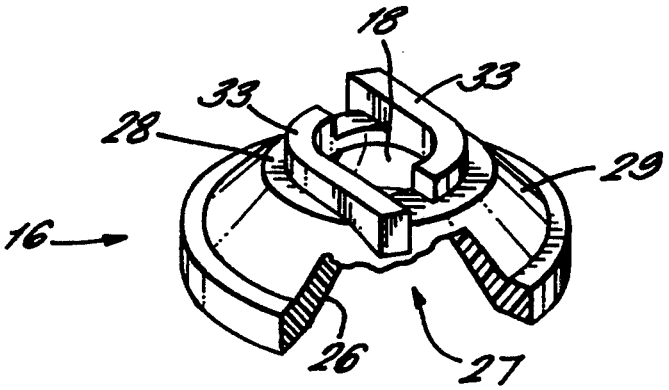
FIG. 6 is an enlarged perspective view of the second nozzle insert.

On completion of the dispensing stroke the actuator is released and is allowed to return to rest position. As shown in FIG. 4 the return stroke is accompanied by expansion of the air chamber 32 with air being drawn into the chamber via channel 31 from the second nozzle aperture 18.

This air flow tends to remove any remaining droplets of liquid in the region of the air gap 30 thereby providing a self-cleaning operation.

The dispensing means may alternatively be a pressurised dispensing container with a valve actuated by depression of the actuator. In this instance the stem 4 becomes an integral part of the valve.

The apparatus 1 of FIG. 1 has a casing 7 which is adapted to be a screw connection to a reservoir 50 and a dip tube may be added to the inlet tube 6 if required. Alternative configurations are possible in which the casing may be crimped or otherwise fitted to a suitable container.

The skirt 38 of the actuator may alternatively be configured to locate externally on the tubular projection 39. Alternatively the tubular projection 39 may be dispensed with and the actuator may have a skirt making sliding contact with a cylindrical external surface of the casing thereby constituting an actuator engaging portion.

I claim:

1. Apparatus for dispensing liquid from a reservoir as an atomized spray, comprising: a delivery means, an actuator defining a dispensing channel and being operatively connected to the delivery means whereby the delivery means is operable by relative movement of the actuator to deliver a flow of liquid to the dispensing channel, a first nozzle connected to the actuator and defining a first nozzle aperture communicating with the dispensing channel, air pumping means operable by movement of the actuator relative to the delivery means to compress an enclosed volume of air during actuation of the delivery means wherein the actuator defines an air ejection channel for the release of the compressed air, wherein the apparatus further includes a second nozzle connected to the actuator externally of the first nozzle, the second nozzle defining a second nozzle aperture and having a rear face spaced from a front face of the first nozzle to define an air gap therebetween, the air gap communicating with the second nozzle aperture and the air ejection channel, wherein the rear face of the second nozzle is conically tapered in a direction toward the first nozzle, the air ejection channel communicating with the air gap at a location circumferential relative to the rear face of the second nozzle whereby in use, a radially inward flow of air entering the air gap is deflected by the rear face of the second nozzle toward the first nozzle and both the liquid spray and the compressed air are dispensed through the second nozzle aperture.

2. Apparatus as claimed in claim 1 wherein the delivery means comprises a body having an actuator engaging portion co-operating with the actuator no define an air chamber, the actuator and the actuator engaging portion being telescopically movable relative to one another to thereby vary the volume of the chamber and constitute the air pumping means.

3. Apparatus as claimed in claim 2 wherein the actuator engaging portion comprises a tubular projection of the body and the actuator comprises depending cylindrical skirt slidably engaging the tubular projection.

4. Apparatus as claimed in claim 3 wherein the skirt is received within the tubular projection in sliding contact with an internal cylindrical surface thereof.

5. Apparatus as claimed in claim, wherein the first nozzle comprises a centrally located axial projection defining the first nozzle aperture and projecting towards the second nozzle.

6. Apparatus as claimed in claim 1 wherein the second nozzle comprises a plurality of axially projecting fins extending non-radially from the rear face of the second nozzle so as to induce swirling motion in air flow in the air gap.

7. Apparatus as claimed in claim 6 wherein the second nozzle comprises a second insert received in a bore defined by the actuator and wherein the fins project into contact with the first nozzle to thereby locate the second nozzle relative to the first nozzle.

8. Apparatus as claimed in claim 7 wherein the first nozzle comprises a first insert received in the bore defined by the actuator and wherein the air gap is annular and bounded by the first insert, the second insert and an intermediate portion of the bore.

9. Apparatus as claimed in claim 1 wherein the second nozzle comprises a front face defining a conically divergent throat which diverges in a direction away from the first nozzle.

10. Apparatus as claimed in claim 1 wherein the delivery means comprises a tubular stem upon which the actuator is mounted and comprises a dispensing pump actuated by depression of the tubular stem.

11. Apparatus as claimed in claim 1 wherein the apparatus for dispensing is actuated by depression of a stem upon which the actuator is mounted.

12. Apparatus as claimed in claim 1, further including a reservoir attached to the delivery means.

13. Apparatus as claimed in claim 12 wherein the reservoir is a pressurized dispensing container.

* * * * *